US008535171B2

(12) United States Patent
McGinnis, Jr.

(10) Patent No.: US 8,535,171 B2
(45) Date of Patent: Sep. 17, 2013

(54) CLUBHEAD WITH EXTERNAL HOSEL

(75) Inventor: Thomas William McGinnis, Jr., Encinitas, CA (US)

(73) Assignee: EHT Golf Design, LLC, Encinitas, CA (US)

( * ) Notice: Subject to any disclaimer, the term of this patent is extended or adjusted under 35 U.S.C. 154(b) by 745 days.

(21) Appl. No.: 12/634,206

(22) Filed: Dec. 9, 2009

(65) Prior Publication Data

US 2011/0059810 A1 Mar. 10, 2011

Related U.S. Application Data

(60) Provisional application No. 61/210,014, filed on Mar. 13, 2009.

(51) Int. Cl.
*A63B 53/02* (2006.01)
*A63B 53/04* (2006.01)

(52) U.S. Cl.
USPC ..... 473/305; 473/324

(58) Field of Classification Search
USPC ..... 473/305, 307, 324–350
See application file for complete search history.

(56) References Cited

U.S. PATENT DOCUMENTS

| | | | | | |
|---|---|---|---|---|---|
| 3,519,271 | A * | 7/1970 | Smith | 473/314 |
| 3,980,301 | A * | 9/1976 | Smith | 473/314 |
| 4,540,178 | A * | 9/1985 | Johnson et al. | 473/335 |
| 5,183,255 | A * | 2/1993 | Antonious | 473/314 |
| 5,222,734 | A * | 6/1993 | Parente et al. | 473/314 |
| 5,513,844 | A * | 5/1996 | Ashcraft et al. | 473/288 |
| 5,601,498 | A * | 2/1997 | Antonious | 473/305 |
| 5,643,104 | A * | 7/1997 | Antonious | 473/305 |
| 5,695,410 | A * | 12/1997 | Brown | 473/305 |
| 5,873,790 | A * | 2/1999 | Yeh | 473/305 |
| 5,935,016 | A * | 8/1999 | Antonious | 473/305 |
| 6,080,068 | A * | 6/2000 | Takeda | 473/305 |
| 6,089,991 | A * | 7/2000 | Yeh | 473/305 |
| 6,299,546 | B1 * | 10/2001 | Wang | 473/314 |
| 7,163,463 | B2 * | 1/2007 | Mills | 473/244 |
| 2005/0064952 | A1 * | 3/2005 | Chen et al. | 473/305 |

FOREIGN PATENT DOCUMENTS

| | | | |
|---|---|---|---|
| JP | 01076882 | A * | 3/1989 |
| JP | 03049777 | A * | 3/1991 |
| JP | 03151988 | A * | 6/1991 |
| JP | 06154366 | A * | 6/1994 |
| JP | 08150228 | A * | 6/1996 |
| JP | 08322974 | A * | 12/1996 |
| JP | 09215785 | A * | 8/1997 |
| JP | 11137731 | A * | 5/1999 |
| JP | 11188123 | A * | 7/1999 |
| JP | 2001259087 | A * | 9/2001 |
| JP | 2005118251 | A * | 5/2005 |
| JP | 2007075278 | A * | 3/2007 |

OTHER PUBLICATIONS

PCT Search Report, Date of Mailing Sep. 22, 201, (5 Pages).

* cited by examiner

*Primary Examiner* — Alvin Hunter

(57) ABSTRACT

A golf club head consisting of a striking face, a soleplate, a crown, and a skirt connecting the face, the soleplate and the crown. A flange is placed at a selected location on the periphery of the skirt. Incorporated into the flange is a hosel, positioned to be displaced from the club head, for receiving the shaft of the golf club. The area of the skirt covered by the flange has a length versus height ratio.

10 Claims, 6 Drawing Sheets

CLUBHEAD WITH EXTERNAL HOSEL

This application is based on and takes priority from U.S. Provisional Patent Application Ser. No. 61/210,014 entitled "Club Head With External Flange," filed on Mar. 13, 2009.

FIELD OF THE INVENTION

This invention pertains to golf apparatus, and more particularly to golf clubs, and more particularly to golf woods, fairway metal club and hybrid style clubs.

BACKGROUND OF THE INVENTION

Golf club makers may use slightly different manufacturing processes. Some parts of the manufacturing process may be unique to one company and regarded as trade secrets. Regardless of the type of process, woods, which may be drivers, fairway woods, and hybrid style clubs, generically "woods," are typically designed the same. Throughout this application, "club head" and "wood head" may be used interchangeably. The head is comprised of a sole (bottom), skirt (about the periphery), a crown (top) and a face (the hitting surface). Formed in the crown and adjacent, and attached to, the skirt is a hosel, which receives the club shaft. The hosel is typically constructed within the periphery of the skirt. When a club is swung, it rotates about the longitudinal axis of the club shaft, and hence the hosel. The speed of rotation is greater as the distance increases along an axis perpendicular to the horizontal axis of the club shaft. In conventional woods the center of gravity is positioned in the vicinity of the longitudinal axis of its club shaft, at some midpoint of the club head, and separated from the horizontal axis of the shaft. The stability of the wood head is adequate because of the relation between the point of application of force, the hosel, and the center of gravity since the axial moment of inertia about the shaft is small. Maximum force is imparted to a golf ball by impacting the wood head where the center of gravity projects to the face of the club. Club manufacturers endeavor to adjust the center of gravity of the club head by placing weights interior to the club head so as to move the center of gravity from the hosel without materially affecting the stability and feel of the club.

U.S. Pat. No. 5,772,526 teaches a club head wherein the hosel is extended from the club head in order to increase the axial moment of inertia. Additionally, the '526 patent discloses a club head in which the hosel is a continuation of, and integral to, the crown of the club head. Both the club face and the soleplate are connected to the neck/hosel. However, any benefits derived from increasing the moment of inertia are lost due to an increase in vibration and loss of stability.

The present invention is designed to minimize these problems while increasing the axial moment of inertia of the club head.

SUMMARY OF THE INVENTION

It is, therefore, an object of the present invention to provide a golf club head including a club head body that includes a striking face, a soleplate, a skirt, a toe, and a heel. It is also an object of the present invention to provide a golf club head wherein the hosel is displaced from the club head by means of a flange. It is also another object of the present invention to provide a club head wherein the hosel may be placed at any point along the skirt of the club head.

In the present invention the flanged hosel, and thus the club shaft, positioned in an external location from the club head. The flanged hosel may be placed at any location on the periphery of the skirt. A range of shaft position options (relative to the plane of the club face) are possible by the permanent positioning of the flanged hosel at various positions on the skirt of the club head. The flanged hosel does not at any point intersect with the crown, sole or face of the club head. This design allows the club head to maintain a consistent shape, allows for an offering of shaft positions that are pleasing to the eye and deliver the club head to impact position based on the individual player type's needs, and thus performance will be improved.

DETAILED DESCRIPTION OF THE INVENTION

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but as a basis for the claims and for teaching one skilled in the art how to make and/or use the invention.

Figure 1:
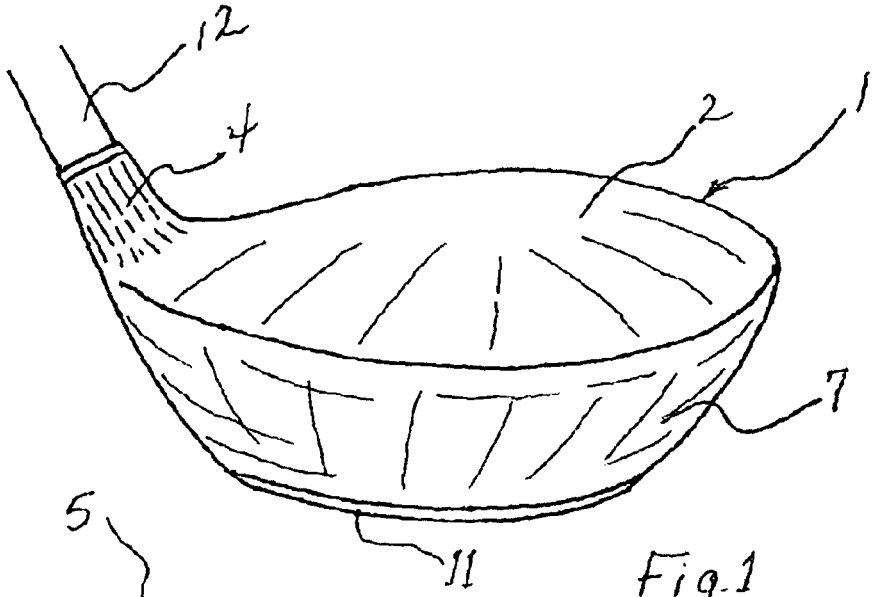
FIG. 1 is a rear perspective view of a conventional prior art golf club head.
Figure 2:
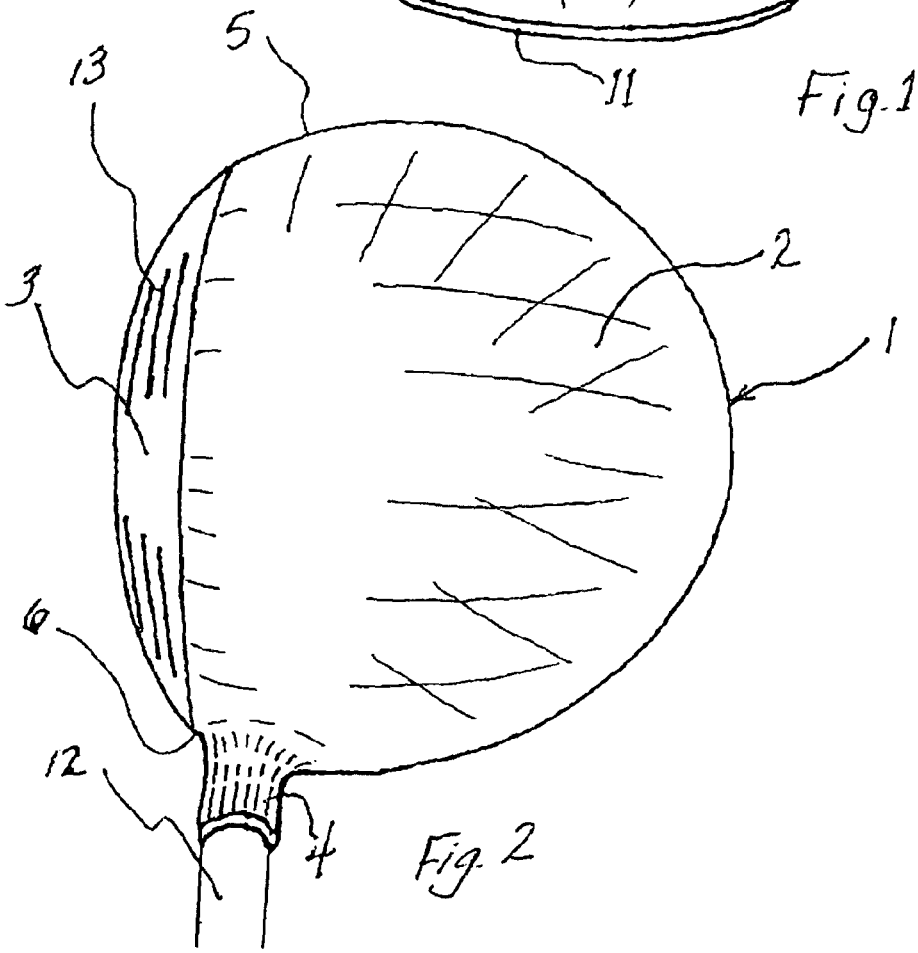
FIG. 2 is a top perspective view of a conventional prior art golf club head.

With reference to FIGS. 1 and 2, a prior art golf club head is shown. The golf club head 1 includes a face 3, a soleplate 11, a crown 2, a toe 5, a heel 6, a skirt 7, or other structure, used in connecting the crown 2 to the soleplate 11, and a hosel 4 to which a golf club shaft 12 is secured, as well as any weight member(s) which might be incorporated into the club head 1. As is readily apparent, the hosel is within the periphery of club head 1, and flows directly from crown 2.

Although a driver type golf club head, frequently called a "wood," is disclosed herein in accordance with a preferred embodiment of the present invention, the concepts underlying the present invention may be applied to a variety of golf club head types, for example, fairway woods and hybrids, without departing from the spirit of the present invention.

Figure 3A:
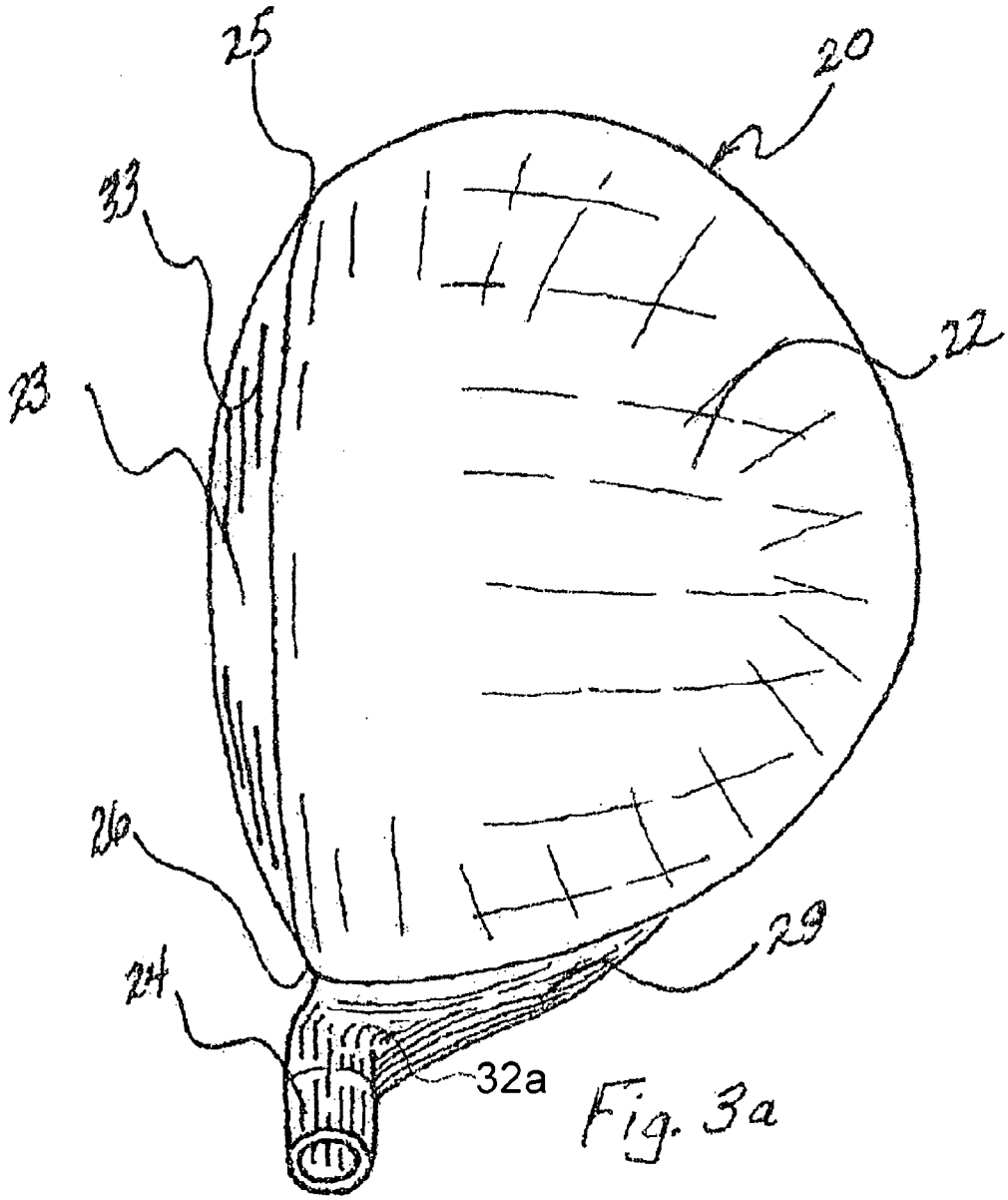
FIG. 3*a* is a top perspective view of a preferred embodiment of a wood-type club head of the invention.
Figure 3B:
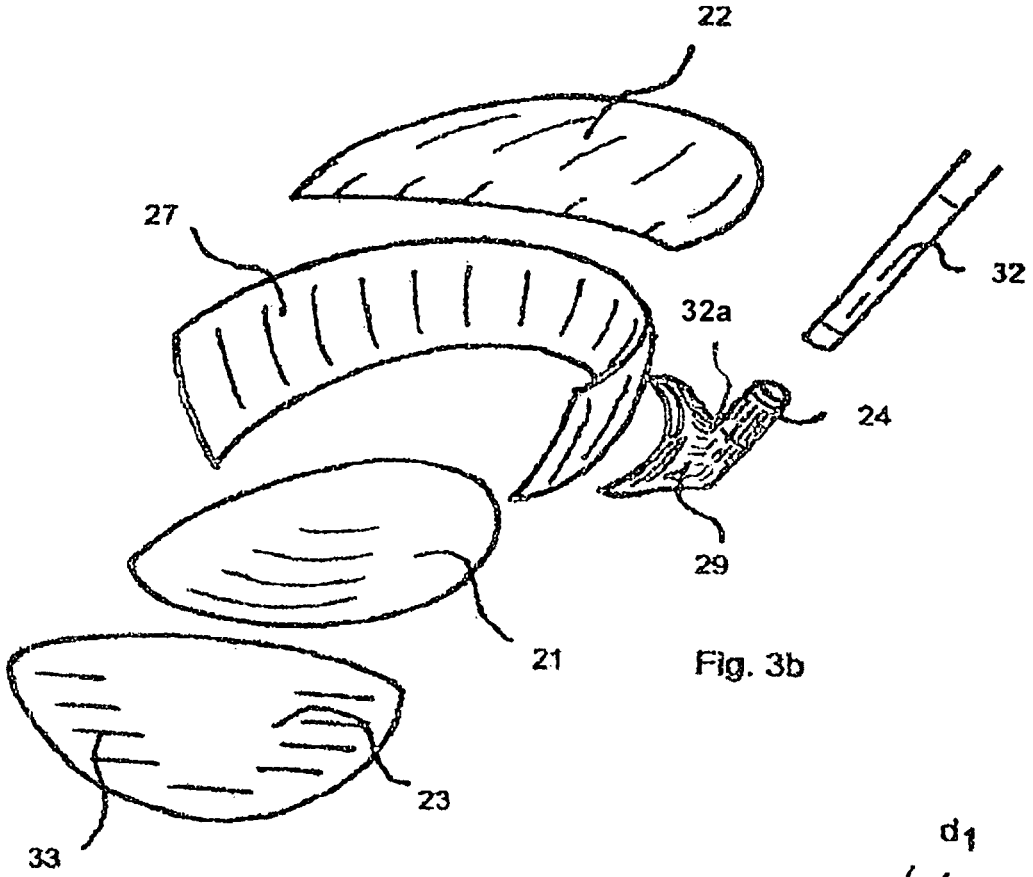
FIG. 3*b* is a lay-out view of the components of a flanged club head.

Referring now to FIGS. 3*a* and 3*b*, these figures describe a wood of the invention wherein the hosel is displaced from the body of the wood club head, i.e., on the periphery of skirt 27 of the club head. The golf club head 20 includes a face 23, a soleplate 21, a crown 22, a toe 25, a heel 26, and a skirt 27. Affixed to skirt 27 is flange 29, which is constructed to receive hosel 24 to which a golf club shaft 32 is secured. The flange 29 forms a channel 32a between the skirt 27 and the hosel 24. The face 23 has a plurality of score lines or grooves 33 thereon to provide spin to the golf ball. Also, the face 23 is attached to the club head 20 around a periphery or rim 1000 of the face 23 (see FIG. 5). As can be seen in the figures, the crown 22, face 23 and soleplate 21 do not intersect any portion of flange 29. This allows club head 20 to maintain a consistent shape and design without altering the components of club head 20. The displacement of hosel 24 from club head 20 permits a more aerodynamic design of the club head.

Figure 4:
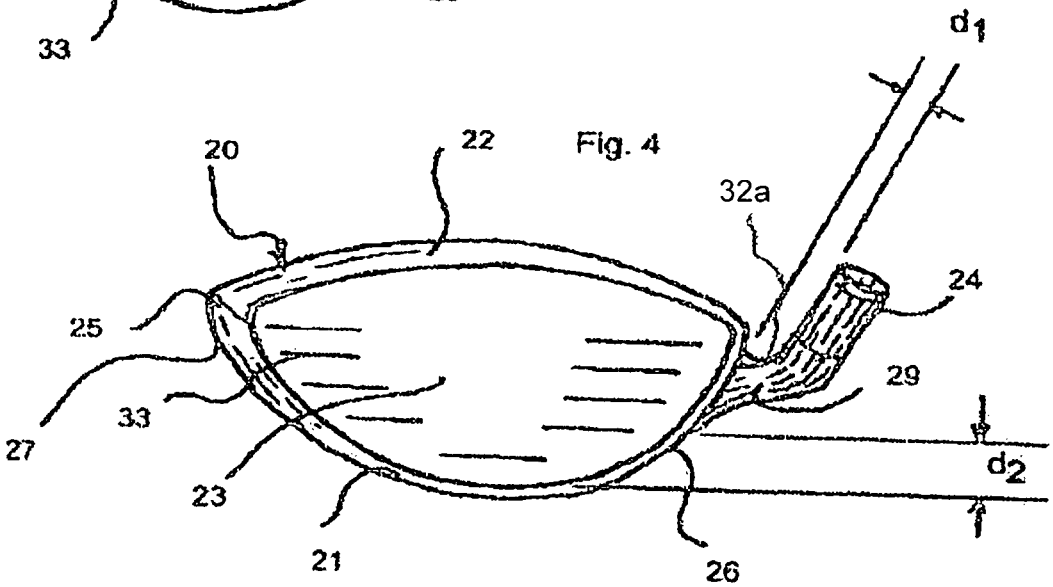
FIG. 4 is a front perspective view of a preferred embodiment of a wood-type club head of the invention showing displacement of the flange from the sole and showing the displacement of the hosel from the heel of the club head.
Figure 5:
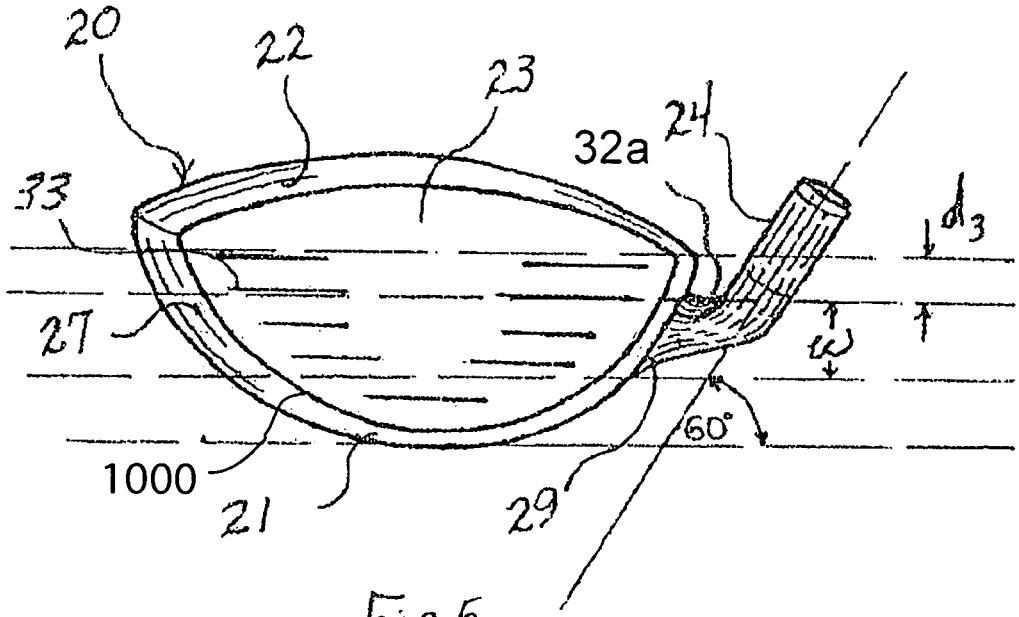
FIG. 5 is a front perspective view of club head of the invention showing displacement of the flange from the crown from the heel of the club head.
Figure 6:
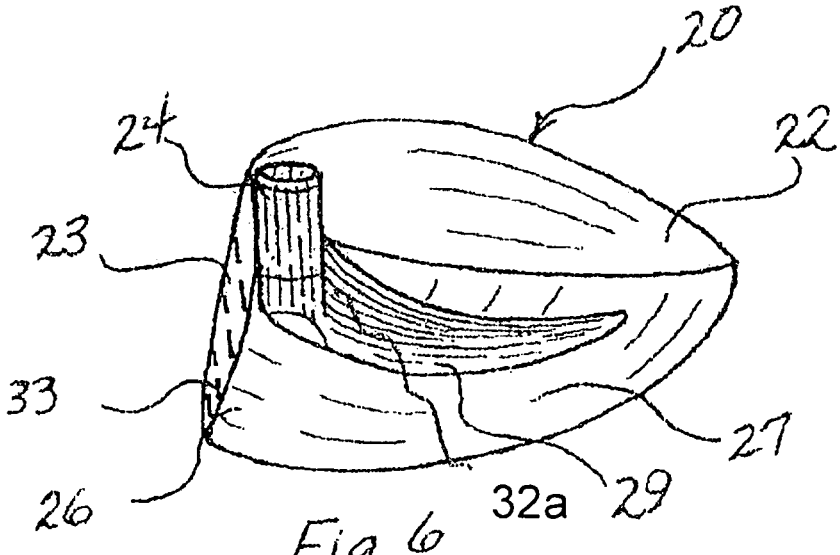
FIG. 6 is a side perspective view of the club head of the invention as seen from the heel of the club head.

Hosel 24 is affixed to or molded with flange 29. Hosel 24 is positioned at a selected angle upward from flange 29. The longitudinal axis of hosel 24 may be at any selected angle relative to face 23 and/or to the heel 26 of club head 20. In the preferred embodiment, this angle is about 60°. Hosel 24 may then receive a club shaft 32 of a selected length and with selected characteristics. Also shown in FIGS. 3-6 and 8-9 are score marks 33, traditionally etched on faces of drivers. FIG. 4 discloses club head 20 with reference lines between the heel portion 26 of skirt 27 (where flange 29 attaches to the skirt) and hosel 24 to show the displacement $d_1$ of the hosel from the club head body. The hosel 24 may be displaced at any selected distance from club head 20, but the minimum distance that hosel 24 may be displaced from the club head body is about 1 mm. Also shown on FIG. 4 is the displacement $d_2$ between soleplate 21 and the lower edge of flange 29. Flange 29 may be displaced any selected distance from soleplate 21, however, the minimum distance that flange 29 may be displaced from soleplate 21 is about 2 mm. FIG. 5 discloses club head 20 with reference lines between the heel end of crown 22 and the top portion of flange 29 where it meets skirt 27, showing distance $d_3$. Flange 29 may be displaced any selected distance from crown 22, however, the minimum distance $d_3$ between crown 22 and the top of flange 29 is about 2 mm. FIG. 5 also shows the width w of flange 29 between crown 22 and soleplate 21. FIG. 6 is a side prospective view of the club head of the invention as seen from the heel of the club head and showing a portion of flange 29 spanning skirt 27.

Figure 7:
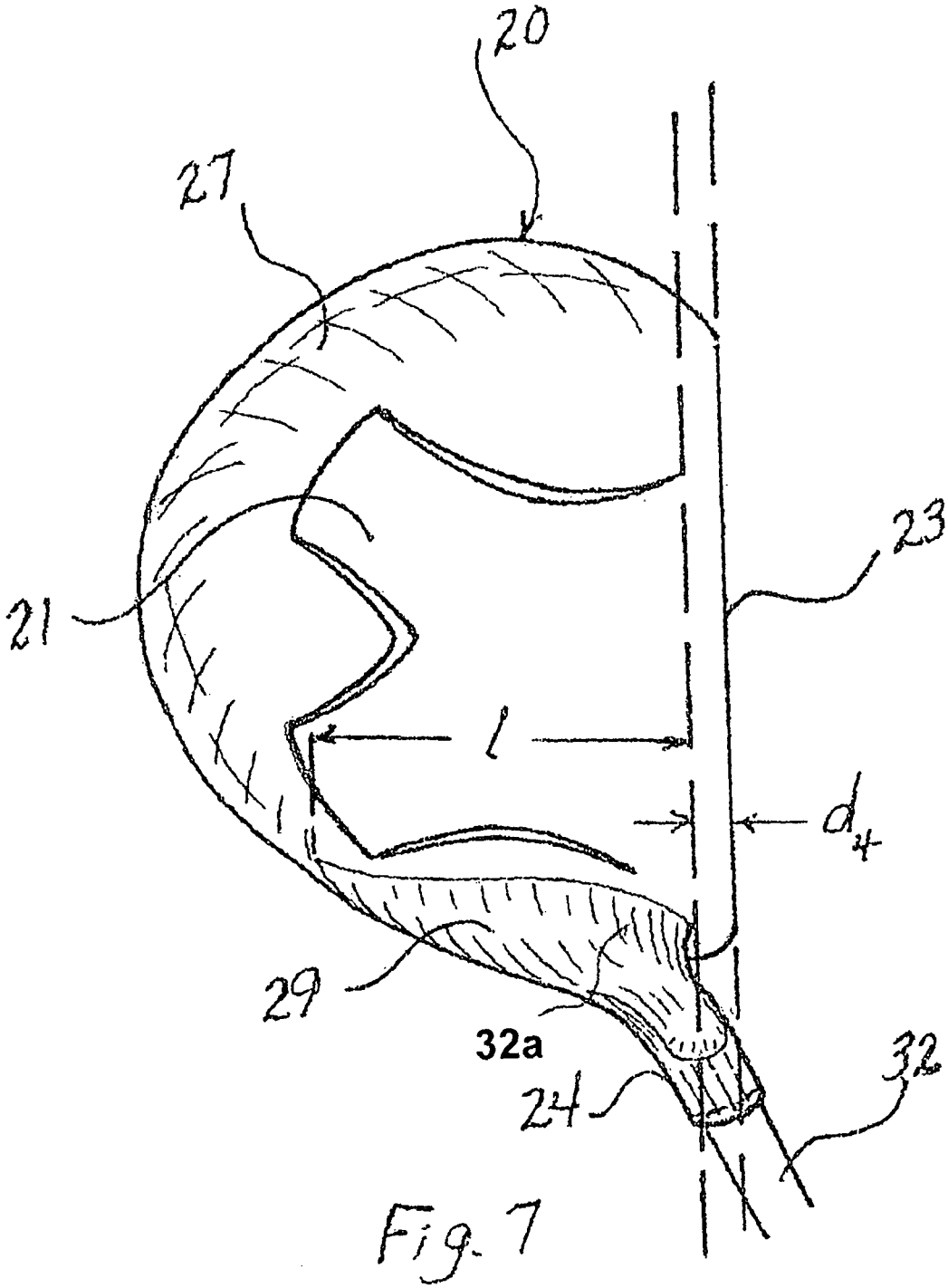
FIG. 7 is a bottom perspective view of the club head of the invention showing the gap between the flange and the club face.

FIG. 7 is a bottom view of club head 20 with soleplate 21 in plan view. The intersection of soleplate 21 and face 23 shows predominantly as a straight line. Distance $d_4$ is the displacement of flange 29 behind the leading edge of face 23. Flange 29 may be displaced any selected distance behind the leading edge of face 23, however, the minimum distance of $d_4$ is 1 mm. Also shown on FIG. 7 is the lateral length l of flange 29 along skirt 27. The length l and width w of the part of the flange attaching to skirt 27 determines the amount of stability of the club head. The minimum ratio of length l versus width w of flange 29 is about 1.25 to 1, but is much greater in this preferred embodiment.

Club head 20 is fabricated in its normal manner except for the absence of hosel 24. Flange 29 is securely fastened to skirt 27 at a selected point on skirt 27 of club head 20, the flange 29 extending to a selected point along the periphery of skirt 27 and either toward the back of the club head, or toward soleplate 21, for providing additional structural support to club head 20. This flange reduces the amount of torque and vibration induced by the club head striking a golf ball and improves the characteristics of the golf club. Since flange 29 may be located at various positions on skirt 27, a club head may be made to specification in order to address a particular golfer's swing and to enable the golfer to more easily square up the club face to the target line at impact, and thus reducing the tendency to miss hit the shot.

With the ability to move hosel 24 forward or backward along the periphery of the club head, more design options are available to specifically relocate the center of gravity to the position delivering optimal performance to the golf ball. The center of gravity will change in the direction of the hosel location. If hosel 24 is situated higher on club head 20, the center of gravity of club head 20 will be higher, and conversely, if hosel 24 is situated lower on club head 20, the center of gravity will be lower. In addition, the additional amount of axial support by flange 29 will produce a better feel to the golfer. This construction also allows position of shaft 32 to be moved in relation to the plane of the club face without altering the design of the actual club head. This allows varying degrees of offset (measurement where the front of the hosel is located in front of the plane of the club face) to be designed into the club. When the shaft is located behind the plane of the club face the measurement (between the shaft's position and the club face plane) is defined as "face progression." These different hosel positions are enabled by the various size and shape possibilities in flange design.

Figure 8:
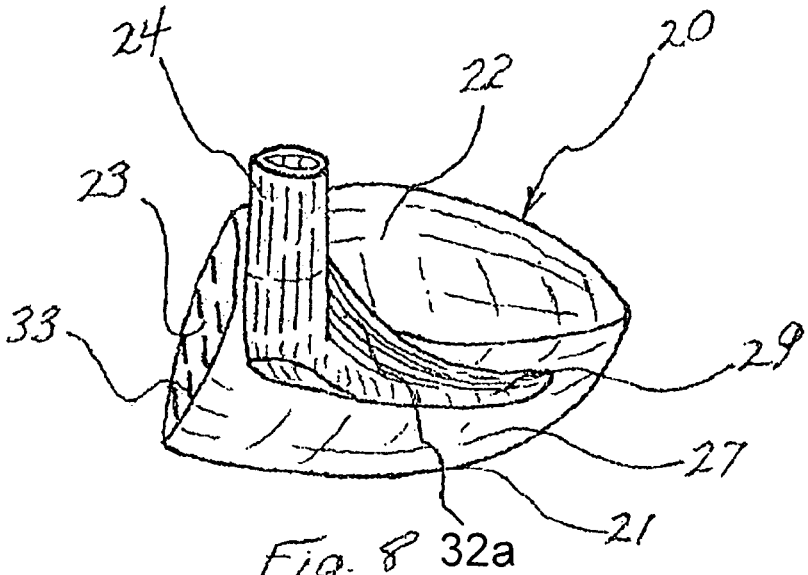
FIG. 8 is a side perspective view of a hybrid club head of the type of the invention.
Figure 9:
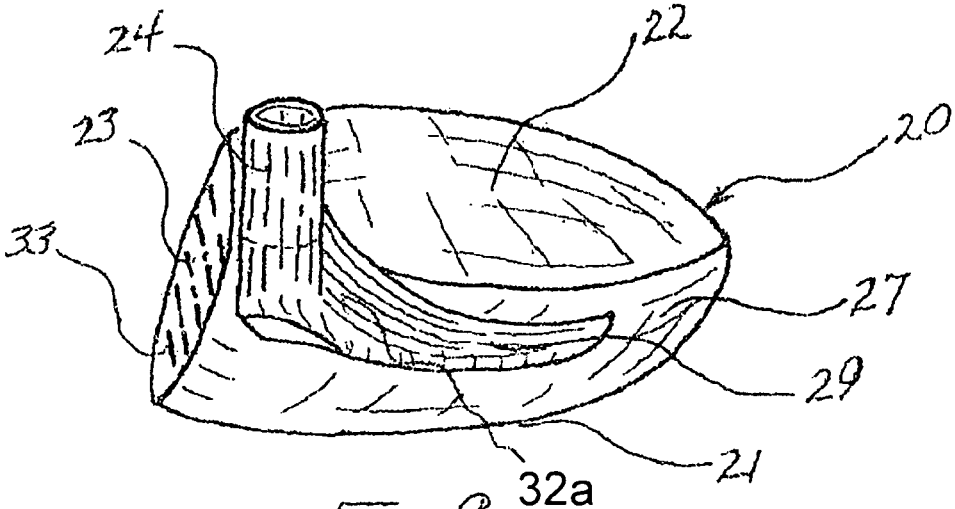
FIG. 9 is a side perspective view of a fairway wood club head of the type of the invention.

FIGS. 8 and 9 disclose a hybrid and fairway wood, respectively, each constructed in the method of the invention with the same numbering for like components.

While the preferred embodiments have been shown and described, it will be understood that there is no intent to limit the invention by such disclosure, but rather, is intended to cover all modifications and alternate constructions falling within the spirit and scope of the invention. For example, the introduction of new materials may change the characteristics of club design, and may permit reducing the size of the flange. This invention may be embodied in many different forms and should not be construed as limited to the embodiments set forth herein; rather, these embodiments are provided by way of illustration only and so that this disclosure will be thorough, complete and will fully convey the full scope of the invention to those skilled in the art. Indeed, many modifications and other embodiments of the invention will come to mind of those skilled in the art to which this invention pertains, and which are intended to be and are covered by both this disclosure, the drawings and the claims.

I claim:

1. A golf club head comprising:

a striking face;

a soleplate;

a crown;

a skirt connecting the face, the soleplate and the crown, and further comprising a periphery;

a flange having a first edge and a second edge, the first edge being attached to and extending from the periphery of the skirt, the flange having a length versus height ratio, and the minimum ratio is 1.25 to 1; and a hosel attached to the second edge of the flange and extending from the flange, wherein the flange forms a channel between the skirt and the hosel and the entire channel is visible from a top plan view of the golf club head.

2. The golf club head of claim 1, wherein the minimum displacement of the hosel from the skirt is 1 mm.

3. The golf club head of claim 1, wherein the minimum displacement of the flange from the soleplate is 2 mm.

4. The golf club head of claim 1, wherein the minimum displacement of the flange from the crown is 2 mm.

5. The golf club head of claim 1, wherein the minimum displacement of the flange from the face is 1 mm.

6. A method for making a golf club head, the method comprising the steps of:

attaching a striking face, a soleplate, and a crown to a skirt having a periphery, attaching a first edge of a flange to the periphery of the skirt, the flange having a length versus height ratio and the minimum ratio is 1.25 to 1, and attaching a second edge of the flange to a hosel such that the flange forms a channel between the skirt and the hosel, and the entire channel is visible from a top plan view of the golf club head.

7. The method of claim 6, wherein the hosel is displaced from the skirt a minimum distance of 1 mm.

8. The method of claim 6, wherein the flange is displaced from the soleplate a minimum distance of 2 mm.

9. The method of claim 6, wherein the flange is displaced from the crown a minimum distance of 2 mm.

10. The method of claim 6, wherein the flange is displaced from the face a minimum distance of 1 mm.

* * * * *